US009079211B1

(12) United States Patent
Deshpande et al.

(10) Patent No.: US 9,079,211 B1
(45) Date of Patent: Jul. 14, 2015

(54) INTERGRANULAR CORROSION (IGC) AND INTERGRANULAR STRESS CORROSION CRACKING (IGSCC) RESISTANCE IMPROVEMENT METHOD FOR METALLIC ALLOYS

(71) Applicant: The United States of America as represented by the Secretary of the Navy, Washington, DC (US)

(72) Inventors: Nishkamraj U. Deshpande, Novi, MI (US); H. Fred Barsun, Bloomington, IN (US); Steven D. Clark, Bloomfield, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/246,797

(22) Filed: Apr. 7, 2014

Related U.S. Application Data

(60) Provisional application No. 61/922,576, filed on Dec. 31, 2013.

(51) Int. Cl.

| | |
|---|---|
| ***B05D 5/00*** | (2006.01) |
| ***B05D 3/10*** | (2006.01) |
| ***B05D 3/00*** | (2006.01) |
| ***B05D 7/14*** | (2006.01) |
| *C22C 21/00* | (2006.01) |
| *C22C 21/06* | (2006.01) |

(52) U.S. Cl.
CPC *B05D 5/00* (2013.01); *B05D 3/002* (2013.01); *B05D 3/102* (2013.01); *B05D 7/14* (2013.01); *C22C 21/00* (2013.01); *C22C 21/06* (2013.01)

(58) Field of Classification Search
CPC ..... C22C 21/00; C22C 21/06; C22C 21/16; C22C 23/02; C22C 23/00; C22C 1/0416; C22C 38/06; C22F 1/04; C22F 1/047; C22F 1/05; C22F 1/06
See application file for complete search history.

(56) References Cited

U.S. PATENT DOCUMENTS

| | | | | |
|---|---|---|---|---|
| 2,658,845 | A * | 11/1953 | Barker | 148/698 |
| 2002/0012605 | A1 * | 1/2002 | Tawara et al. | 420/533 |
| 2007/0068605 | A1 * | 3/2007 | Statnikov | 148/558 |
| 2007/0092739 | A1 * | 4/2007 | Steele et al. | 428/450 |

* cited by examiner

*Primary Examiner* — Duy Deo
(74) *Attorney, Agent, or Firm* — Christopher A. Monsey

(57) ABSTRACT

A method, structure, and/or material composition associated with overetching a structure or allow of interest to deplete magnesium content at and in a vicinity of grain boundaries which mitigates or prevents corrosion including, for example, intergranular corrosion (IGC) and/or intergranular stress corrosion cracking (IGSCC). Another aspect of the invention can include a process and material composition associated with providing a particular coating having a number of material properties. Additional steps, material composition(s), and/or exemplary structure(s) can also be provided which provides a nano coating over the depletion zone having a first coating in accordance with another embodiment of the invention.

3 Claims, 4 Drawing Sheets

INTERGRANULAR CORROSION (IGC) AND INTERGRANULAR STRESS CORROSION CRACKING (IGSCC) RESISTANCE IMPROVEMENT METHOD FOR METALLIC ALLOYS

CROSS-REFERENCE TO RELATED APPLICATIONS

The present application claims priority to U.S. Provisional Patent Application Ser. No. 61/922,576, filed Dec. 31, 2013, entitled "INTERGRANULAR CORROSION (IGC) AND INTERGRANULAR STRESS CORROSION CRACKING (IGSCC) RESISTANCE IMPROVEMENT METHOD FOR METALLIC ALLOYS," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 103,029) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to corrosion prevention associated with field of intergranular corrosion (IGC) and/or intergranular stress corrosion cracking (IGSCC) resistance. Intergranular corrosion is a special form of corrosion characterized by the preferential attack of the grain boundaries. Intergranular corrosion (IGC) is also referred to as intergranular attack (IGA). IGC corrosion only occurs if the grain boundary regions are compositionally different from the bulk of the alloy. This compositional difference occurs during usage of the structure exposed to with time, or heat treating, aging, or welding by diffusion of atoms and precipitation of second phase particles. In 5000 series Al—Mg alloys with high Mg content (>3% Mg) solid solution is supersaturated with Mg solute atoms, because the Mg content is higher than 1.9% Mg, which is the equilibrium solubility of Mg in Al-matrix at room temperature. In that case, Mg solute atoms tend to precipitate out as an equilibrium β-phase ($Mg_5Al_8$) along the grain boundaries or randomly distributed in the structure during usage of the structure exposed to with time, or heat treating, aging, or welding by diffusion of atoms and precipitation of second phase particles. Precipitation sequences of the decomposition of supersaturated solid solution have been reported earlier as follows:

α-Al matrix→GP zones→(β'-phase→(β-phase ($Mg_5Al_8$)

This process occurs slowly even at room temperature, and could be significantly accelerated at high temperatures (>65° C.). Since the corrosion potential of β-phase (−1.24V), is more negative than the potential of Al-matrix (−0.87V), dissolution of anodic (β-phase particles would occur in an appropriate solution, such as seawater. Corrosion, particularly in highly corrosive environments, is a substantial maintenance problem. A desirable aspect of manufacturing of equipment is to prevent corrosion rather than take corrective actions after corrosion has occurred. Classic responses to corrosion include chipping, scraping, painting and washing structures on a continual basis. However, up front prevention leverages downstream savings.

According to one illustrative embodiment of the present disclosure, an exemplary process includes a method, structure, and/or material composition associated with overetching a structure or allow of interest to create a depletion zone or deplete magnesium content at and in a vicinity of grain boundaries which mitigates or prevents corrosion including, for example, IGC and/or IGSCC. Another aspect of the invention can include a process, structure and/or a material composition associated with providing a particular coating, e.g., a ceramic coating of various alloy parts, e.g., aluminum parts such as discussed herein. Additional steps, material composition(s), and/or exemplary structure can also be provided which provides a nano coating over a depletion zone having a first coating in accordance with an embodiment of the invention.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1B:
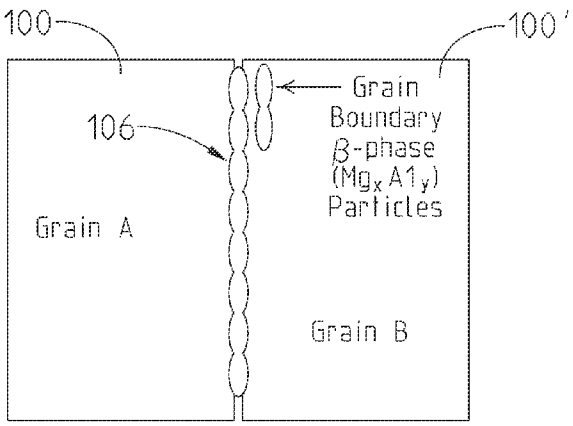
FIG. 1*b* schematically shows the formation of β-phase formed at grain boundaries due to diffusion of Magnesium (Mg) atoms to grain boundaries of one structure which is vulnerable to various types of corrosion FIG. 1*c* schematically shows the formation of Magnesium depleted areas adjacent to β-phase formed at the at grain boundaries during service of one structure.
Figure 1A:
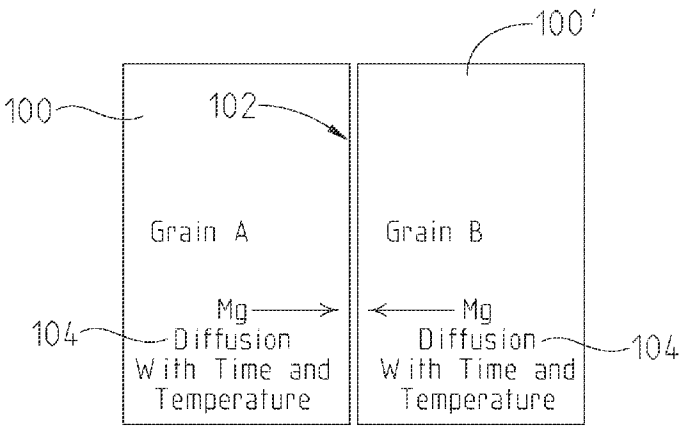
FIG. 1*a* schematically shows a first sample microstructure of a high magnesium containing 5000 series alloy prior to corrosion and depicts the phenomena of diffusion of Mg atoms to grain boundaries during service of a structure which gets exposed temperatures higher than 65° C. for shorter times, or even at room temperature for longer times.
Figure 1C:
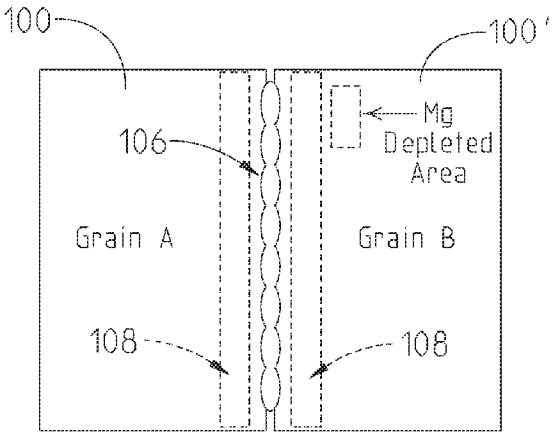
FIG. 1*d* shows a typical microstructure having β-phase particles formed at grain boundaries of a high magnesium containing 5000 series alloy.
FIG. 1 *e* shows a sample exposed to corrosive media, where the grain boundary β-phase particles which are more anodic compared to the adjoining grains, corrode and get removed from the grain boundaries, causing intergranular corrosion at one or more grain boundary surfaces and one or more stress fractures.
FIG. 1*f* shows a typical grain boundary crack formation due to ingress of the corrosive media from surface to the interior of the structure and progressive corrosion and dissolution of the grain boundary β-phase particles.
Figure 1D:
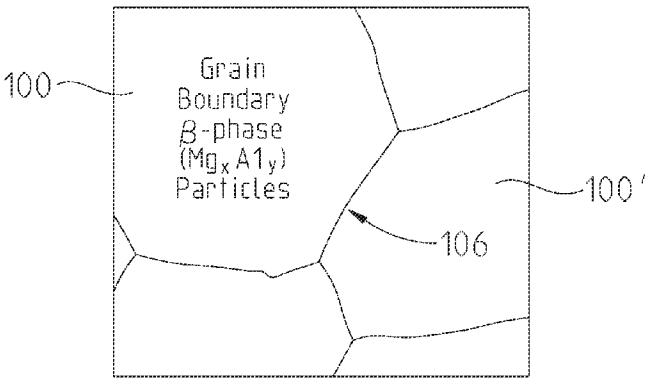
Figure 1F:
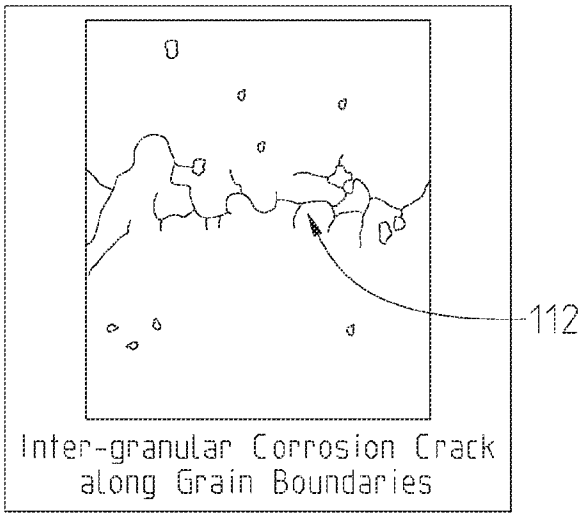
Figure 1E:
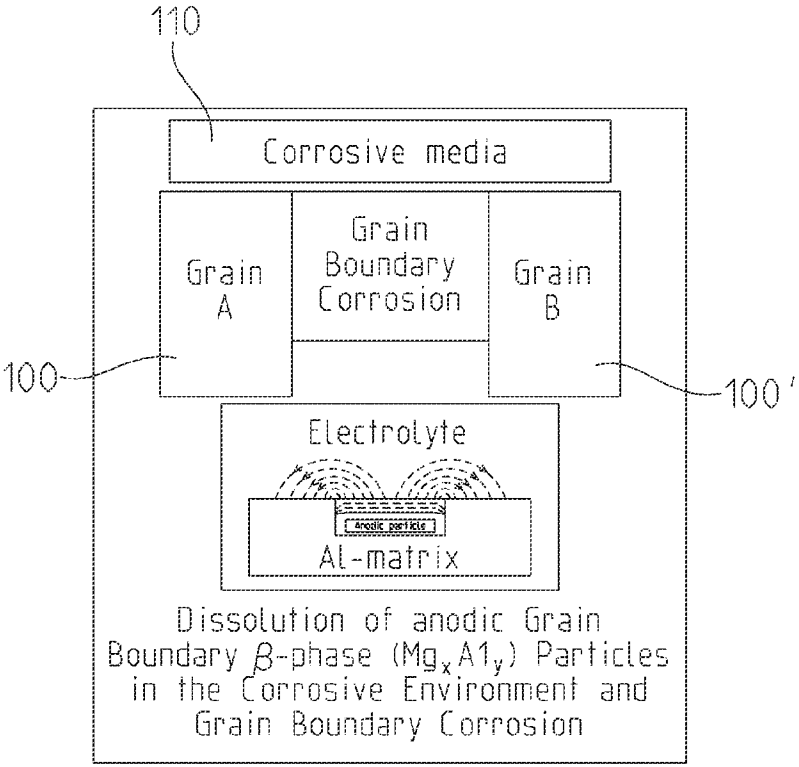

In one exemplary embodiment, aluminum 5XXX series alloys are commonly used for ship structures. When the exemplary 5XXX alloy with >3% Magnesium (Mg) is exposed to elevated temperatures for long periods of time, Mg atoms diffuse to grain boundaries (see FIG. 1*a*) and form β-phase (either $Mg_2Al_3$ or $Mg_5Al_8$ depending on alloy and hence is designated as $Mg_xAl_y$ in the grain boundaries (FIGS. 1*b*, 1*c* and 1*d*). FIG. 1*a* schematically shows a first sample microstructure prior to corrosion. FIG. 1*e* schematically shows the shows a sample exposed to corrosive media, where the grain boundary β-phase particles which are more anodic compared to the adjoining grains get preferentially corroded with respect to the grains and get removed from the grain boundaries, causing intergranular corrosion at one or more grain boundary surfaces and one or more stress fractures In this example, this β-phase being anodic causes intergranular corrosion at the grain boundary surface and intergranular stress corrosion cracking (IGSCC) and stress fracture (FIG. 1*f*) at locations inside the thickness of the alloy by allowing corrosive media entrance and further causing further corrosion of β-phase containing grain boundaries. This exemplary embodiment of the invention includes a focus on how to prevent/reduce grain boundary corrosion of an AA5XXX aluminum alloy as described herein.

Figure 2A:
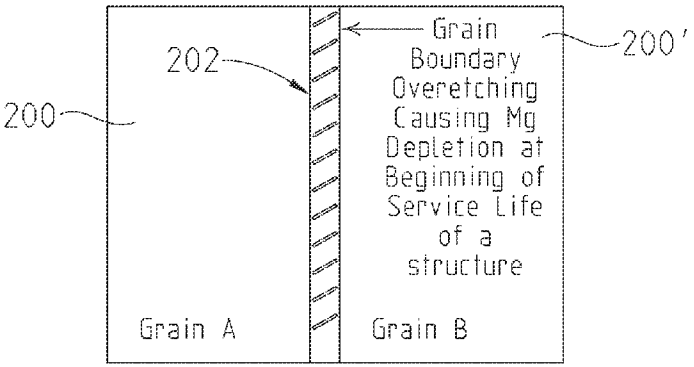
FIG. 2*a* grain boundary overetching step at beginning of service life of a structure causing Magnesium depleted zone obtained by application of a process associated with the invention, e.g., overetching in accordance with an exemplary embodiment of the invention.
Figure 2B:
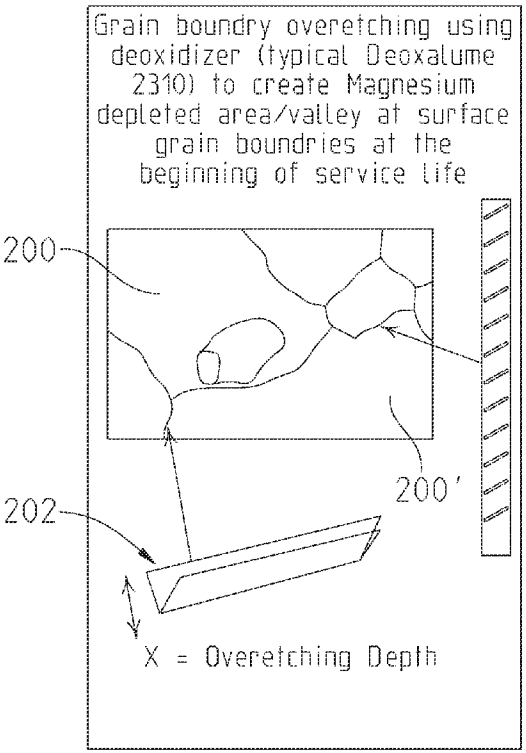
FIG. 2*b* shows a diagram of a structure having a surface grain boundaries subjected to deoxidizer (typical Deoxalume 2310) treatment, which are in overetched to desired overetched depth, designated as, "X", and having magnesium depleted surface grain boundary structure
Figure 2C:
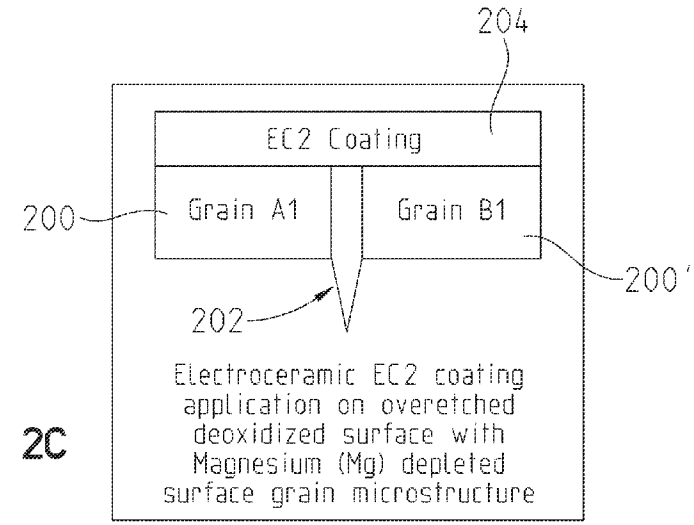
FIG. 2*c* shows a diagram of the FIG. 2*c* structure after a coating step associated with an exemplary embodiment of the invention.

A β-phase does not form at grain boundaries in the initial stages of a service life. Overetching of a part surface as shown in FIGS. 2*a* and 2*b*, at the start of part life, to remove/reduce the magnesium content of the alloy material at and in a vicinity of a grain boundaries of a surface layer grains will help in reducing surface layer corrosion in service. Valleys formed due to over-etching, at these grain boundaries can be located on the part surface which can be filled by application of some coating material (FIG. 2*c* shows an exemplary coating called electro ceramic coating (EC2)) which is hydrophobic and adhesive to aluminum alloy which can further reduce surface corrosion and hence can provide corrosion resistance to subsurface layers.

A general method associated with one embodiment of the invention can include a first step of depletion of a β-phase precipitate forming magnesium containing material from the surface layers at and in the vicinity of one or more grain boundaries associated with a part or work piece; a second step of applying hydrophobic, electrically semi conductive/insulative, thermally insulative material coating or coatings to reduce one or more heat transfer property of the part or work piece (and thus, in one embodiment, reduce diffusion of magnesium atoms at one or more grain boundaries located at or beneath the part or work piece's surface). The exemplary coating in accordance with an embodiment of the invention can be significantly less vulnerable to ingress of corrosive media (and thus can prevent intergranular corrosion of surface layer(s) and/or one or more underlying subsurface layers and improve IGC and IGSCC resistance). Accordingly, in one embodiment, a material overetching step followed by a coating process step, such as described herein, so as to fill the grain boundary area(s) can provide significant advantages.

Figure 3:
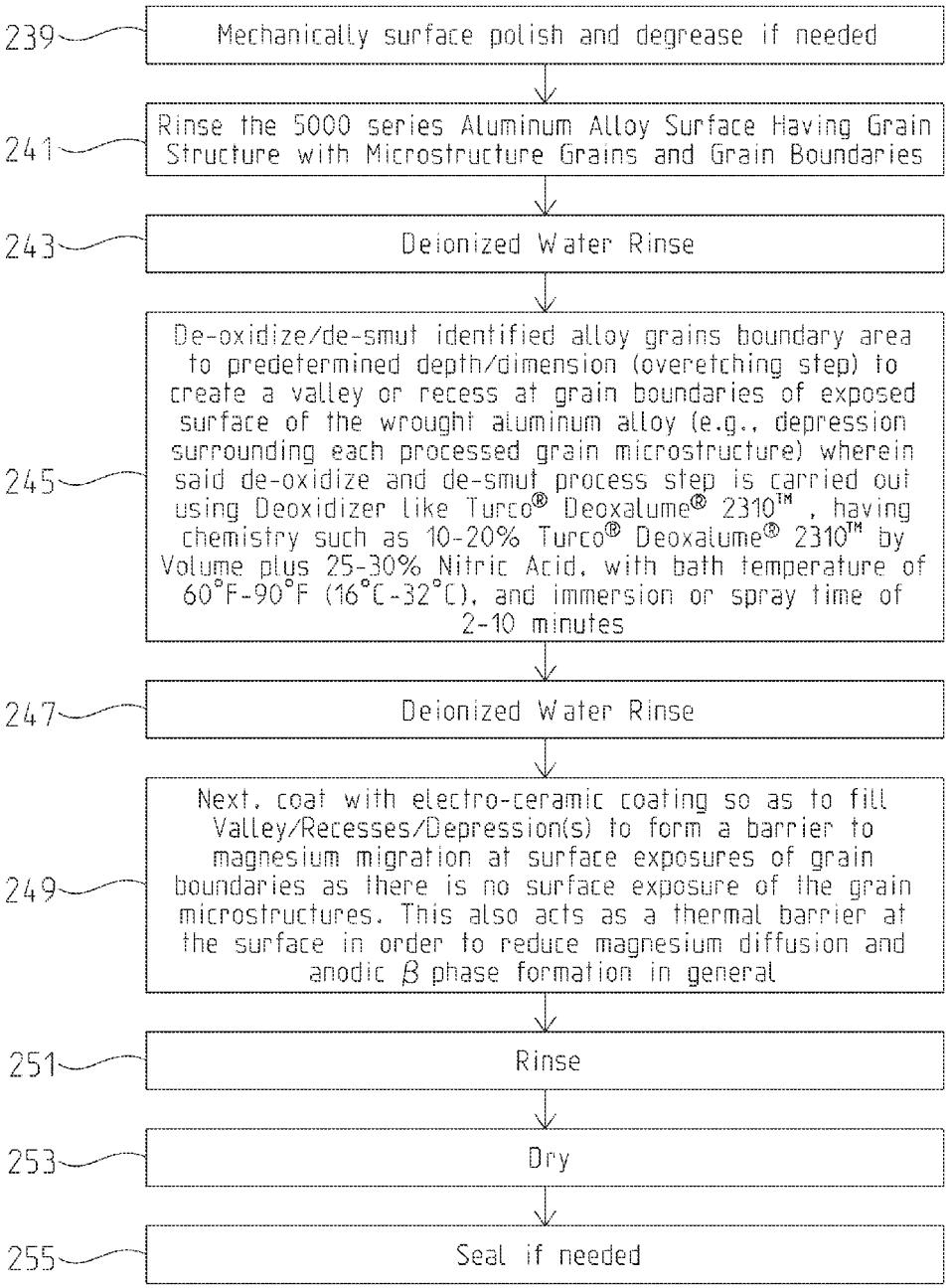
FIG. 3 shows a method of manufacturing in accordance with an embodiment of the invention.

In a more particular exemplary embodiment, process steps can include a first processing step of over etching grain boundaries of a part or workpiece's surface layer(s) to reduce a magnesium content in surface grain boundary and its vicinity areas as shown in FIGS. 2*a* and 2*b* and then followed with a cleaning step of the overetched surface; A second step can include applying applying a hydrophobic, electrically semi/insulative, thermally insulative, hard, galvanically compatible coating material layer on the as overetched surface having grain boundary network and grains, as shown in FIG. 2*c*. FIG. 3 shows a method of manufacturing in accordance with an embodiment of the invention.

Step: 139 Mechanically surface polish and degrease if needed, Step: 141: Rinse the 5000 series Aluminum Alloy Surface Having Grain Structure with Microstructure Grains and Grain Boundaries. Step 143: Deionized Water Rinse. Step 145: De-Oxidize/De-smut Identified Alloy Grain Boundary Area to Predetermined Depth/Dimension (Overetching Step) to Create a Valley or Recess at Grain Boundaries of Exposed Surface (e.g., depression surrounding each processed grain microstructure). Step 147: Deionized Water Rinse. Step 149: Next, coat with electro-ceramic coating so as to fill Valley/Recesses/Depression(s) to form a barrier to magnesium migration at surface exposures of grain boundaries as there is no surface exposure of the grain microstructures. This also acts as a thermal barrier at the surface in order to reduce magnesium formation in general. Step 151: Rinse. Step 153: Dry, Step 155: Seal if needed Another exemplary embodiment can also add a third step that can include providing coating layer(s) having nano capsules containing adhesive fluid which would seal or fill in grain boundary cracks that can arise in a part or work piece's surface during its service life.

Another exemplary embodiment can include applying an embodiment of the invention, e.g., such as described above, can also be used to repair an in-service part(s) or workpiece (s).

Although the invention has been described in detail with reference to certain preferred embodiments, variations and modifications exist within the spirit and scope of the invention as described and defined in the following claims.

The invention claimed is:

1. A method comprising:

depletion of a β-phase precipitate forming magnesium containing material from one or more surface layers at and in a vicinity of one or more grain boundaries associated with a part or work piece;

applying hydrophobic, electrically semi conductive/insulative, thermally insulative material coating to reduce a heat transfer property of the part or work piece with an effect of reducing diffusion of magnesium atoms at one or more said grain boundaries located beneath the part or work piece's surface;

providing coating layer(s) having nano capsules containing adhesive fluid which would seal or fill in grain boundary cracks that can arise in a part or work piece's surface during its service life.

2. A method of claim 1, wherein said depletion step comprises a material overetching step and said applying of said material coating process step so as to fill the grain boundary areas.

3. A method comprising:

overetching grain boundaries of an area or areas of a part or work piece's to reduce a magnesium content in one or more surface grain boundary and its vicinity areas;

cleaning the overstretched grain boundaries area or areas of said part or work piece; and applying a hydrophobic, electrically semi/insulative, thermally insulative, hard, galvanically compatible coating material layer or layers on the overetched grain boundary/boundaires of said area or areas having grain boundary network and grains;

providing coating layer(s) having nano capsules containing adhesive fluid which would seal or fill in grain boundary cracks that can arise in a part or work piece's surface during its service life.

* * * * *